US005704531A

United States Patent [19]

Nam

[11] Patent Number: 5,704,531

[45] Date of Patent: Jan. 6, 1998

[54] TENNIS BALL HOLDING ARTICLE

[76] Inventor: Richard Nam, 11808 Laughton Way, Northridge, Calif. 91326

[21] Appl. No.: 791,909

[22] Filed: Jan. 31, 1997

[51] Int. Cl.[6] ..... A45F 3/00; B65D 3/00

[52] U.S. Cl. ..... 224/676; 224/650; 224/654; 224/657; 224/660

[58] Field of Search ..... 224/676, 657, 224/919, 318, 650, 652, 654, 250, 660, 662, 677, 682, 683, 235, 236; 383/117, 118, 97; 2/94, 247, 250; 206/315.9

[56] References Cited

U.S. PATENT DOCUMENTS

| | | | |
|---|---|---|---|
| D. 277,810 | 3/1985 | Pickens | D2/383 |
| D. 282,694 | 2/1986 | Gault | D2/381 |
| 1,810,813 | 6/1931 | Bertini | 383/117 |
| 3,963,157 | 6/1976 | Truax et al. | 224/5 D |
| 4,079,871 | 3/1978 | Sica | 224/5 D |
| 4,416,404 | 11/1983 | Daniels | 224/224 |
| 4,433,803 | 2/1984 | Liberboim | 224/251 |
| 4,836,427 | 6/1989 | McManus | 224/224 |
| 5,176,253 | 1/1993 | Perrin et al. | 224/919 |
| 5,288,150 | 2/1994 | Bearman | 383/117 |
| 5,289,960 | 3/1994 | Kelly et al. | 224/226 |
| 5,323,897 | 6/1994 | Sperber | 383/117 |
| 5,326,005 | 7/1994 | Fisher | 224/245 |
| 5,401,101 | 3/1995 | Wang | 383/117 |

*Primary Examiner*—Henry J. Recla
*Assistant Examiner*—Timothy L. Maust
*Attorney, Agent, or Firm*—Eugene Oak

[57] ABSTRACT

A tennis ball holding article comprising a zippered compartment which accommodates a plurality of tennis balls, and a belt which allows the present invention to be worn around the waist. The zippered compartment of the present invention tightly and securely accommodates a plurality of tennis balls. A zipper disposed along the upper end of the zippered compartment provides access to the balls. When a ball is needed, the zipper is unzipped until a ball is made accessible. When the ball is removed, because the zippered compartment retains the remaining tennis balls very tightly, the zipper can remain in this intermediate position until another ball is needed. The zipper may then be unzipped further until the next ball is made accessible. Because the zipper does not have to be zipped and unzipped to secure the remaining tennis balls, the present invention provides a tennis player with extremely quick and convenient access to a plurality of tennis balls. In addition, the present invention does not require a great amount of material for construction and therefore does not burden the tennis player during a match.

2 Claims, 2 Drawing Sheets

TENNIS BALL HOLDING ARTICLE

BACKGROUND OF THE INVENTION

1. Field of the Invention

The present invention generally relates to a sports utility belt, and specifically to a tennis ball holding belt for the purpose of securely holding a plurality of tennis balls during the practice or play of a tennis match and also providing convenient access to the tennis balls during practice or play.

2. Description of the Prior Art

The prior art teaches several variations of tennis ball holding articles which are worn around the waist. However, none of the prior art teach a tennis ball holding article as taught by the present invention.

U.S. Pat. No. 4,836,427 to McManus, U.S. Pat. No. 4,433,803 to Liberboim, U.S. Pat. No. 3,963,157 to Truax, D282,694 to Gault, and D277,810 to Pickens each utilize a plurality of compartments wherein each compartment accommodates a single tennis ball. Because a plurality of compartments are necessary to hold a plurality of tennis balls, each of these inventions require extensive amounts of construction material to make proper and adequate items. The present invention, however, does not provide a single compartment for each tennis ball, but instead implements a single compartment which retains a plurality of balls, thereby saving construction material and also providing a more lightweight article which is less burdensome for the bearer of the present invention.

U.S. Pat. No. 5,326,005 to Fisher discloses a ball carrying device which is similar in likeness and utility to a holster. The present invention, however, does not operate similarly to a holster. U.S. Pat. No. 4,079,871 to Sica discloses a belt-type garment for carrying tennis balls and the like which utilizes an elastic strip to retain the balls within the garment. The present invention, however, does not utilize an elastic strip to retain tennis balls. U.S. Pat. No. 4,416,404 to Daniels discloses a belt-type garment for carrying tennis balls comprising a belt portion having on one extremity devices thereon for removably fastening the belt portion around the waist of the wearer. The present invention does not teach an article to be affixed onto a belt, but teaches an article which is worn around the waist with or without a belt. U.S. Pat. No. 5,289,960 to Kelly et al. discloses a ball belt which comprises to semi-oval pieces of fabric which form an elastic pouch attached to a nylon belt. However, the compartment taught by the present invention does not retain tennis balls in the same or similar manner as the ball belt taught by Kelly et al. Thus, the prior art does not teach a tennis ball holding article similar to the present invention.

Accordingly, the primary object of the present invention is to provide a tennis ball holding article which is capable of holding a plurality of tennis balls, wherein the article is intended to be worn around the waist of the bearer and can be worn during the play or practice of a tennis match without causing any hindrance or discomfort.

Another object of the present invention is to provide a tennis ball holding article which provides convenient access to a plurality of tennis balls during the play or practice of a tennis match.

Yet another object of the present invention is to provide a tennis ball holding article which is conveniently put on and taken off.

A further object of the present invention is to provide a tennis ball holding article which requires a minimal amount of construction material which contribute to a lower manufacturing cost and a lightweight product.

SUMMARY OF THE INVENTION

The present invention is a tennis ball holding article intended to be worn around the waist which provides convenient access to a plurality of tennis balls during the play or practice of a tennis match. The tennis ball holding article comprises an elongated strip of resilient fabric and a corresponding elongated strip of translucent resilient mesh which are attached together along the perimeters of both strips except along one elongated end, wherein a zipper is attached along the unattached elongated end of both strips therefore providing means of allowing and restricting access to the space between both strips.

With this zippered compartment in a fully unzipped configuration, a plurality of tennis balls may be placed inside the zippered compartment in a single-file orientation, albeit rather fittingly, and the plurality of tennis balls may be secured within the compartment when the compartment is in a fully zipped configuration. When the zippered compartment is unzipped through a distance slightly greater than the diameter of a tennis ball, the tennis ball located at that end of the zippered compartment becomes accessible and can be easily removed from the zippered compartment. The zipper can be left at that partially unzipped configuration until another tennis ball is needed. The zippered compartment can then be further unzipped until the next tennis ball is made accessible. Because the zippered compartment tightly accommodates the plurality of tennis balls, the plurality of balls inside the zippered compartment securely remain in the compartment even when the zipper is not fully closed. This provides the wearer of the present invention with quick and ready access to a tennis ball which is beneficial during the play and/or practice of a tennis match.

Two straps each attached to opposite ends of the zippered compartment and each bearing fastening means to one other allow the present invention to be worn. In addition, the mesh used in the construction of the present invention provides visibility to the contents inside the zippered compartment (i.e. the make or number printed on the ball). Because a minimal amount of material is used in constructing this article, the lightweight and unburdensome characteristics of the present invention provide a tennis player with an exceptional ball holding article.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
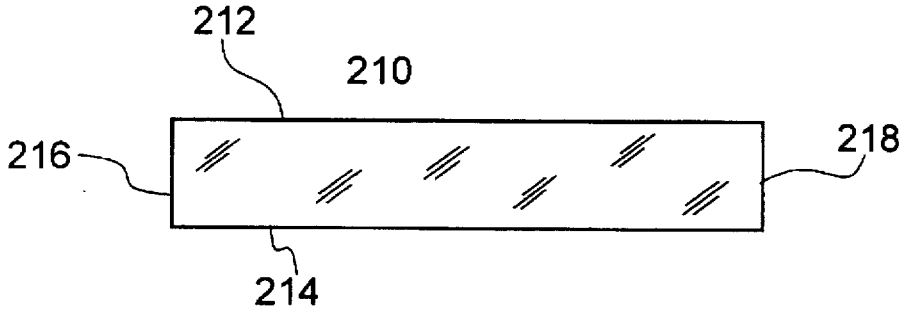
FIG. 1 is a front view of the elongated piece of stretchable fabric.
Figure 2:
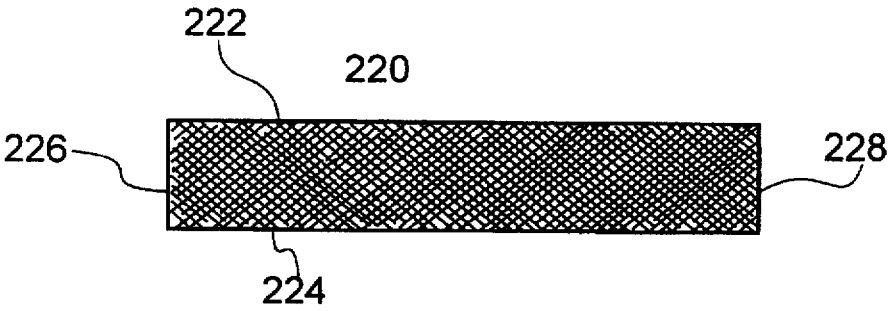
FIG. 2 is a front view of the elongated piece of resilient mesh.
Figure 3:
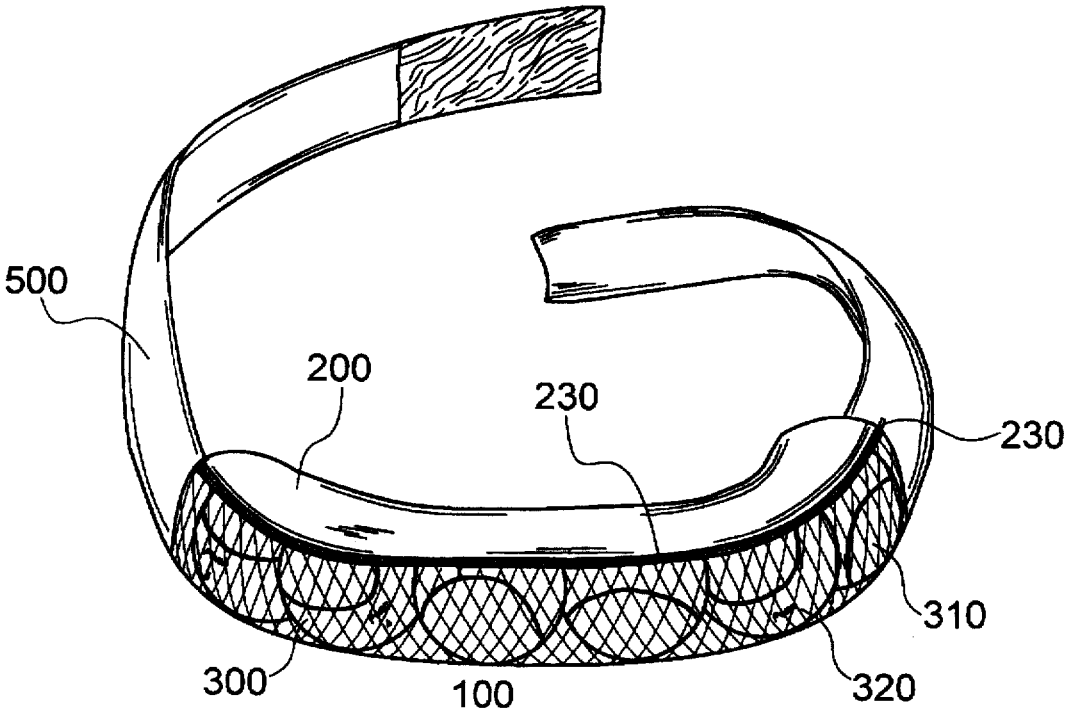
FIG. 3 is a front perspective view of the present invention.

Referring to FIG. 1, FIG. 2 and FIG. 3, the tennis ball holding article 100 comprises an elongated zippered compartment 200 which comprises an elongated strip of stretchable fabric 210 and a corresponding elongated strip of resilient mesh 220. The elongated strip of fabric 210 has an upper edge 212, a lower edge 214, a first side edge 216, and a second side edge 218. The elongated strip of mesh has an upper edge 222, a lower edge 224, a first side edge 226, and a second side edge 228. In constructing the zippered compartment 200, the lower edge 214 of the elongated strip of fabric 210 is attached to the lower edge 224 of the elongated strip of mesh 220, the first side edge 216 of the elongated strip of fabric 210 is attached to the first side edge 226 of the elongated strip of mesh 220, and the second side edge 218 of the elongated strip of fabric 210 is attached to the second side edge 228 of the elongated strip of mesh 220. The mesh 220 and fabric 210 are attached together by conventional means, such as sewing them together, or using an adhesive. Referring to FIG. 3, a zipper 230 is attached to and along the upper edge 212 of the elongated strip of fabric 210 and the upper edge 222 of the elongated strip of mesh 220, wherein the zipper 230 regulates access into the space between the two strips 210 and 220.

With the zipper 230 in an unzipped position, a plurality of tennis balls may be placed inside the elongated zippered compartment 200 in a single-file orientation, albeit rather fittingly, and the plurality of tennis balls may be secured within the compartment 200 when the compartment 200 is in a fully zipped configuration. FIG. 3 depicts the compartment 200 in a fully zipped configuration, wherein a plurality of tennis balls 300 are stored therein. The mesh 220 allows the plurality of tennis balls 300 to be seen which is particularly useful in distinguishing the brand and number printed on each ball.

When the zippered compartment 200 is unzipped through a distance slightly greater than the diameter of a tennis ball, the tennis ball 310 located at that end of the zippered compartment 200 becomes accessible and can be easily removed from the zippered compartment 200. The zipper 230 can be left at that partially unzipped configuration until another tennis ball is needed. The zippered compartment 200 can then be further unzipped until the subsequently positioned tennis ball 320 is made accessible. Because the zippered compartment 200 tightly accommodates the plurality of tennis balls 300, the plurality of balls 300 inside the zippered compartment 200 securely remain in the compartment 200 even when the zipper 230 is not fully closed. This provides the wearer of the present invention with quick and ready access to a tennis ball, which is beneficial during the play and/or practice of a tennis match.

Figure 4:
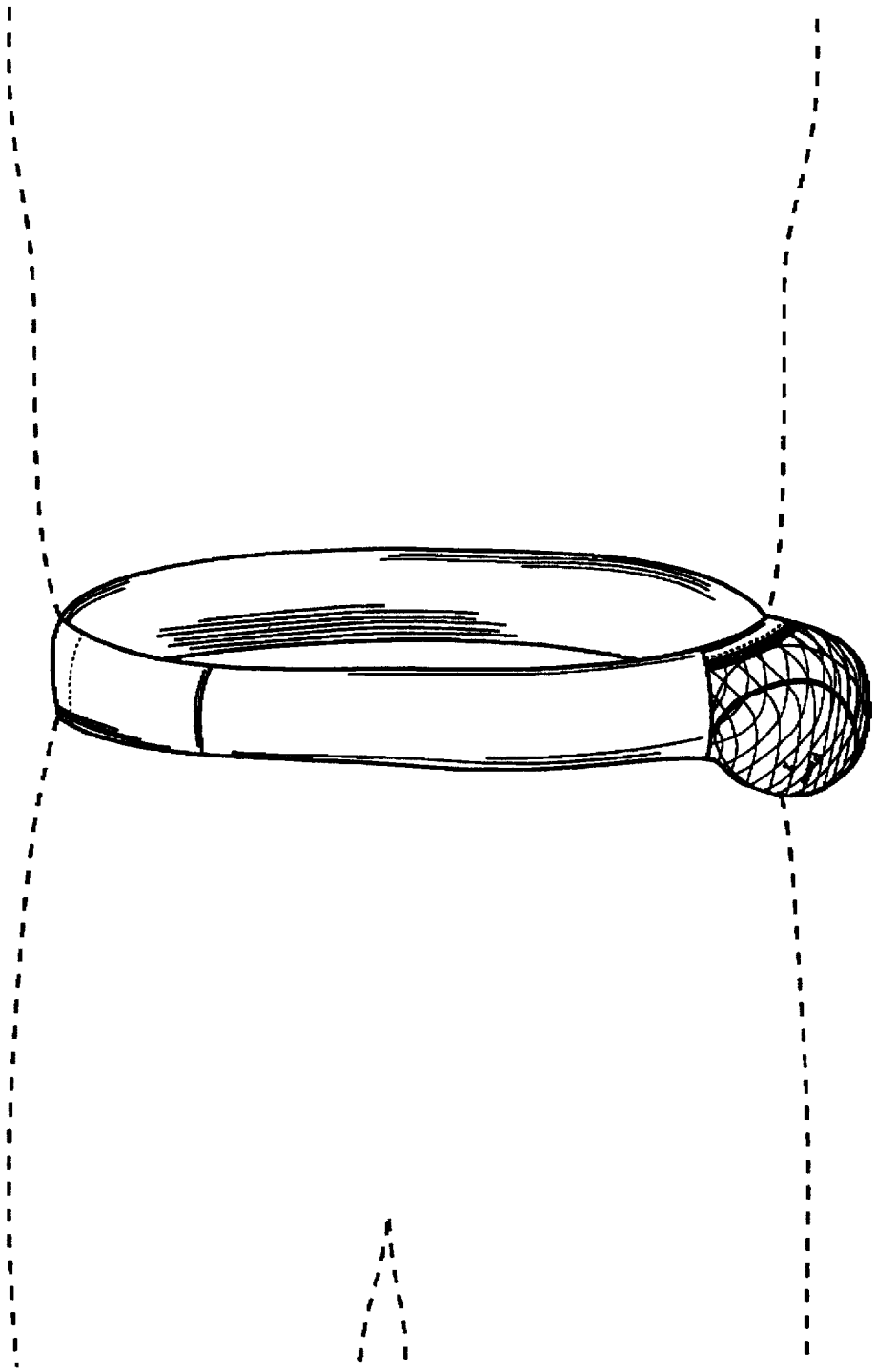
FIG. 4 depicts the present invention being worn in a conventional manner.

A belt utilizing some type of fastening means, for example Velcro™, may be attached to the present invention thereby enabling the invention to be worn around the waist. FIG. 3 depicts a belt 500 attached to the present invention. FIG. 4 depicts the present invention being worn in the intended manner with a belt 500.

In alternate embodiments of the present invention, different lengths of the elongated piece of resilient mesh 220 and elongated piece of stretchable fabric 210 can be utilized to create a zippered compartment which accommodates varying amounts of tennis balls, wherein the optimal amount of tennis balls accommodated by the present invention is between six and ten balls.

What is claimed as being new and therefore desired to be protected by Letters Patent of the United States is as follows:

1. A tennis ball holding article comprising a zippered compartment, said zippered compartment comprising an elongated piece of stretchable fabric and an elongated piece of resilient mesh, each having an upper edge, a lower edge, a first side edge, and a second side edge, said first side edge of said elongated piece of stretchable fabric affixed to said first side edge of said elongated piece of resilient mesh, said second side edge of said elongated piece of stretchable fabric affixed to said second side edge of said elongated piece of resilient mesh, said lower edge of said elongated piece of stretchable fabric affixed to said lower edge of said elongated piece of resilient mesh, wherein a zipper is affixed to and connects said elongated piece of resilient mesh and said elongated piece of stretchable fabric, said zipper affixed to said elongated piece of resilient mesh along said upper edge of the same, said zipper affixed to said elongated piece of stretchable fabric along said upper edge of the same, wherein a plurality of tennis balls in a single-file orientation is accommodated inside said zippered compartment, said zippered compartment tightly and securely accommodating said plurality of tennis balls due to said elongated piece of resilient mesh and said elongated piece of stretchable fabric, wherein said mesh is transparent to permit convenient observance of said plurality of tennis balls, wherein a first belt strap is affixed to an end of said tennis ball holding article, wherein a second belt strap is affixed to an opposite end of said tennis ball holding article, wherein corresponding fastening means are affixed to said first belt strap and said second belt strap thereby allowing said tennis ball holding article to be worn around the waist.

2. A tennis ball holding article comprising a zippered compartment, said zippered compartment comprising an elongated piece of stretchable fabric and an elongated piece of resilient mesh, each having an upper edge, a lower edge, a first side edge, and a second side edge, said first side edge of said elongated piece of stretchable fabric affixed to said first side edge of said elongated piece of resilient mesh, said second side edge of said elongated piece of stretchable fabric affixed to said second side edge of said elongated piece of resilient mesh, said lower edge of said elongated piece of stretchable fabric affixed to said lower edge of said elongated piece of resilient mesh, wherein a zipper is affixed to and connects said elongated piece of resilient mesh and said elongated piece of stretchable fabric, said zipper affixed to said elongated piece of resilient mesh along said upper edge of the same, said zipper affixed to said elongated piece of stretchable fabric along said upper edge of the same, wherein a plurality of tennis balls in a single-file orientation is accommodated inside said zippered compartment, said zippered compartment tightly and securely accommodating said plurality of tennis balls due to said elongated piece of resilient mesh and said elongated piece of stretchable fabric, wherein said mesh is transparent to permit convenient observance of said plurality of tennis balls, wherein a first belt strap is affixed to an end of said tennis ball holding article, wherein a second belt strap is affixed to an opposite end of said tennis ball holding article, wherein corresponding fastening means are affixed to said first belt strap and said second belt strap thereby allowing said tennis ball holding article to be worn around the waist, wherein said first belt strap is made of elastic to provide a tight and secure fit around the waist.

* * * * *